US011772853B2

(12) United States Patent
Gu

(10) Patent No.: US 11,772,853 B2
(45) Date of Patent: Oct. 3, 2023

(54) STORAGE CONTAINER

(71) Applicant: Hyunwoo Gu, Seoul (KR)

(72) Inventor: Hyunwoo Gu, Seoul (KR)

( * ) Notice: Subject to any disclaimer, the term of this patent is extended or adjusted under 35 U.S.C. 154(b) by 238 days.

(21) Appl. No.: 17/287,521

(22) PCT Filed: Oct. 17, 2019

(86) PCT No.: PCT/KR2019/013621
§ 371 (c)(1),
(2) Date: Apr. 22, 2021

(87) PCT Pub. No.: WO2020/085713
PCT Pub. Date: Apr. 30, 2020

(65) Prior Publication Data

US 2021/0387772 A1 Dec. 16, 2021

(30) Foreign Application Priority Data

Oct. 25, 2018 (KR) ..... 10-2018-0127878

(51) Int. Cl.
*B65D 43/02* (2006.01)
*B65D 45/16* (2006.01)
*B65D 53/02* (2006.01)

(52) U.S. Cl.
CPC ..... *B65D 43/0202* (2013.01); *B65D 45/16* (2013.01); *B65D 53/02* (2013.01)

(58) Field of Classification Search
CPC .... B65D 43/0202; B65D 45/16; B65D 53/02; B65D 43/022; B65D 2543/00379; B65D 43/161
(Continued)

(56) References Cited

U.S. PATENT DOCUMENTS 3,392,870 A * 7/1968 Schulz ..... B65D 43/161 220/651
3,870,190 A 3/1975 Tibbals, Jr. et al.
(Continued)

FOREIGN PATENT DOCUMENTS

EP 0078646 A1 5/1983
KR 10-0736433 B1 7/2007
(Continued)

OTHER PUBLICATIONS

International Search Report in International Application No. PCT/KR2019/013621, dated Mar. 23, 2020, 2pages.

*Primary Examiner* — James N Smalley
(74) *Attorney, Agent, or Firm* — Park, Kim & Suh, LLC

(57) ABSTRACT

A storage container is disclosed, which includes: a container body; a folding line enabling folding and unfolding; a cover comprising a first and a second cover provided on the left and right sides of the folding line; a rotary pressing member rotatably provided on or near the folding line; and an elastic element coupled to the outer edge or inner side of the cover, wherein the cover can be inserted into the container body while folded, the cover is unfolded by a rotation of the rotary pressing member in one direction, the rotary pressing member is coupled to the cover so that the elastic element comes tightly contacts the inner wall surface of the container body and the cover maintains an unfolded state, and the cover is folded by a rotation of the rotary pressing member in the other direction so as to be separable from the container body.

14 Claims, 10 Drawing Sheets

(58) Field of Classification Search
USPC ..... 220/803, 826, 263
See application file for complete search history.

(56) References Cited

U.S. PATENT DOCUMENTS

| | | | | | |
|---|---|---|---|---|---|
| 3,896,962 | A * | 7/1975 | Smith | ..... | B42F 15/0094 220/543 |
| 5,190,152 | A * | 3/1993 | Smith | ..... | B42F 15/0094 220/826 |

FOREIGN PATENT DOCUMENTS

| | | | |
|---|---|---|---|
| KR | 10-0828907 | B1 | 5/2008 |
| KR | 10-2019-0033243 | A | 3/2019 |
| KR | 10-1940016 | B1 | 4/2019 |
| WO | 2017/183937 | A1 | 10/2017 |

* cited by examiner

STORAGE CONTAINER

CROSS-REFERENCE TO RELATED APPLICATIONS

This application is the National Stage filing under 35 U.S.C. 371 of International Application No. PCT/KR2019/013621, filed on Oct. 17, 2019, which claims the benefit of Korean Patent Application No. 10-2018-0127878, filed on Oct. 25, 2018, the contents of which are all hereby incorporated by reference herein in their entirety.

BACKGROUND

1. Technical Field

The present invention relates to a storage container capable of containing an object.

2. Description of the Related Art

Storage containers are currently widely used to keep food products, etc., in a hygienic manner for extended periods. The conventional storage container may be composed of a cover and a container body, with four rotary members (locking flaps) provided on the perimeter of a quadrilateral cover. The rotary members may couple onto protrusions, etc., formed on the perimeter of the container body, whereby the cover may be coupled to the container body. On the inner side of the cover, a packing may be provided for sealing.

In the conventional storage container described above, the cover may be coupled to the container body by the rotary members, where the packing may be compressed to thus provide a sealing effect. However, the conventional storage container may be inconvenient to use, since all four of the rotary members have to be opened or locked.

European patent publication EP 0 078 646 discloses a storage container equipped with a foldable cover. With the storage container disclosed in said prior art, the user can separate the cover from the container body by folding the foldable cover and can couple the cover with the container body by placing the foldable cover on the container body.

However, the storage container disclosed in said prior art provides a weak seal, since there is no means for maintaining the cover in an unfolded state, and the channels formed along the edge of the cover merely receive the upper portions of the container body. In addition, the storage container disclosed in said prior art has a structure that is difficult to open and close with one hand.

SUMMARY OF THE INVENTION

Technical Problem

The present invention was conceived to resolve the problems described above, and an aspect of the present invention is to provide a storage container that is convenient to use.

Another aspect of the present invention is to provide a storage container that provides a strong seal and allows the user to separate or couple the cover using just one hand.

Other objectives of the present invention will be more clearly understood from the embodiments described below.

Technical Solution

A storage container according to one aspect of the present invention comprises: a container body, a cover that includes a folding line enabling folding and unfolding and a first cover and a second cover provided on a left and a right side of the folding line, as well as a rotary pressing member rotatably provided on or near the folding line and an elastic element coupled to an outer edge or an inner side of the cover, where the cover is configured to be insertable onto the container body while in a folded state with respect to the folding line, the cover is unfolded with respect to the folding line by a rotation of the rotary pressing member in one direction, a coupling of the rotary pressing member onto the cover and/or the container body causes the elastic element to tightly contact an inner wall surface of the container body and causes the cover to maintain an unfolded state, and the cover is folded with respect to the folding line by a rotation of the rotary pressing member in the other direction so as to be separable from the container body.

A storage container based on the present invention can include one or more of the following features. For example, the elastic element can be formed from a rubber or flexible plastic material and can be formed as an integrated body with or assembled onto the cover.

The cover can include an outer protrusion and/or an inner groove to which the elastic element may be coupled, and an end portion of the folding line serving as an elastic deformation segment can protrude with the same length as the outer protrusion.

The elastic element can be formed from a rubber or flexible plastic material and can be formed as an integrated body with or assembled onto the cover.

The rotary pressing member can be formed as an integrated body with the cover or can be formed as a separate body and assembled onto the cover.

The rotary pressing member can include a pressing protrusion, and a rotation of the cover in one direction can cause the pressing protrusion to press the folding line such that the first cover and second cover maintain an unfolded state.

One of a rotation detent protrusion and an anti-detachment protrusion provided on the rotary pressing member can be coupled to or pressed against the other of a cover detent protrusion and a holding indentation provided on the cover such that the rotary pressing member presses down on the cover in an unfolding direction and/or maintains a coupled state with the cover.

The elastic element can create an overlap when placed in tight contact with an inner wall surface of the container body.

The container body can include an inner ledge, and the cover can be supported on the inner ledge.

The container body can include an inner wall surface having a flat form, and the cover can be capable of upward and downward movement while the elastic element is in tight contact with the inner wall surface.

The rotary pressing member can include a body protrusion, the container body can include an insertion notch to which the body protrusion may be rotatably coupled, and a rotation of the body protrusion while inserted in the insertion notch can cause the cover to maintain an unfolded state or be pressed in a downward direction for unfolding.

When the cover is inserted onto or separated from the container body, the first cover and the second cover can be folded in an inverted "V" shape.

The container body can be shaped as any one of a circle, rectangle, square, and polygon.

Advantageous Effects

The present invention can provide a storage container that is convenient to use.

Also, the present invention can provide a storage container that provides a strong sealing effect and allows the user to separate or couple the cover with just one hand.

Also, the present invention can provide a storage container with which the height of the cover can be adjusted within the container body in correspondence to the height of the object placed within the container body.

DETAILED DESCRIPTION OF THE INVENTION

Figure 1:
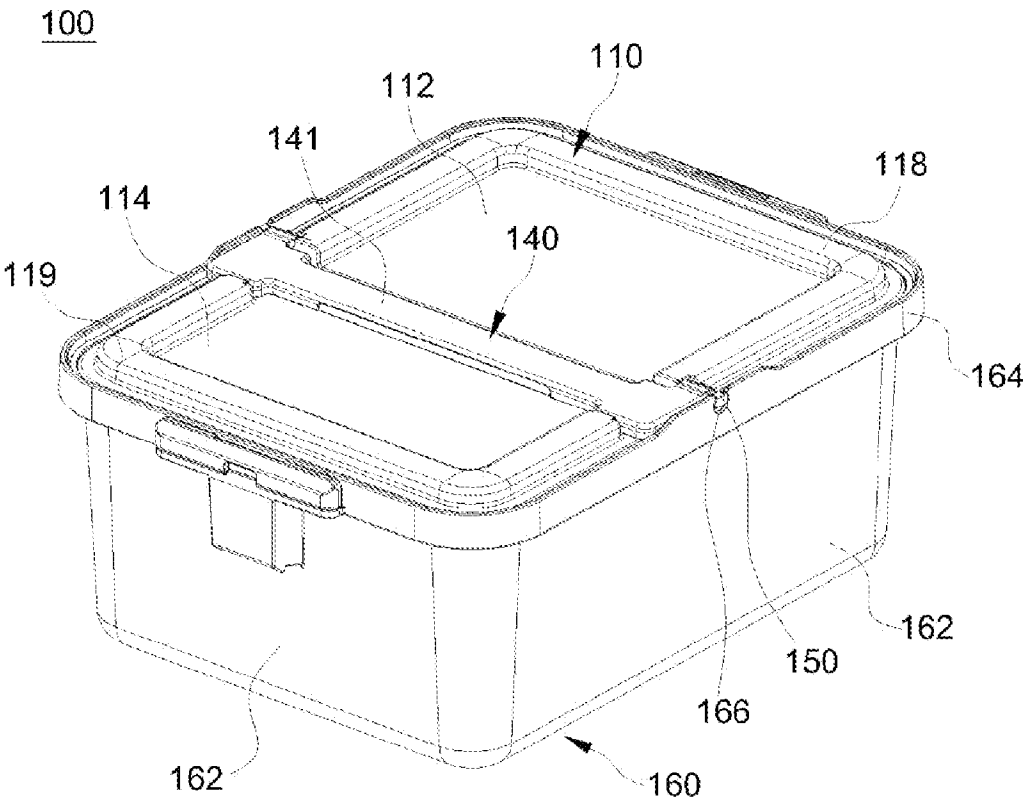
FIG. 1 is a perspective view illustrating a storage container according to an embodiment of the present invention.
Figure 2:
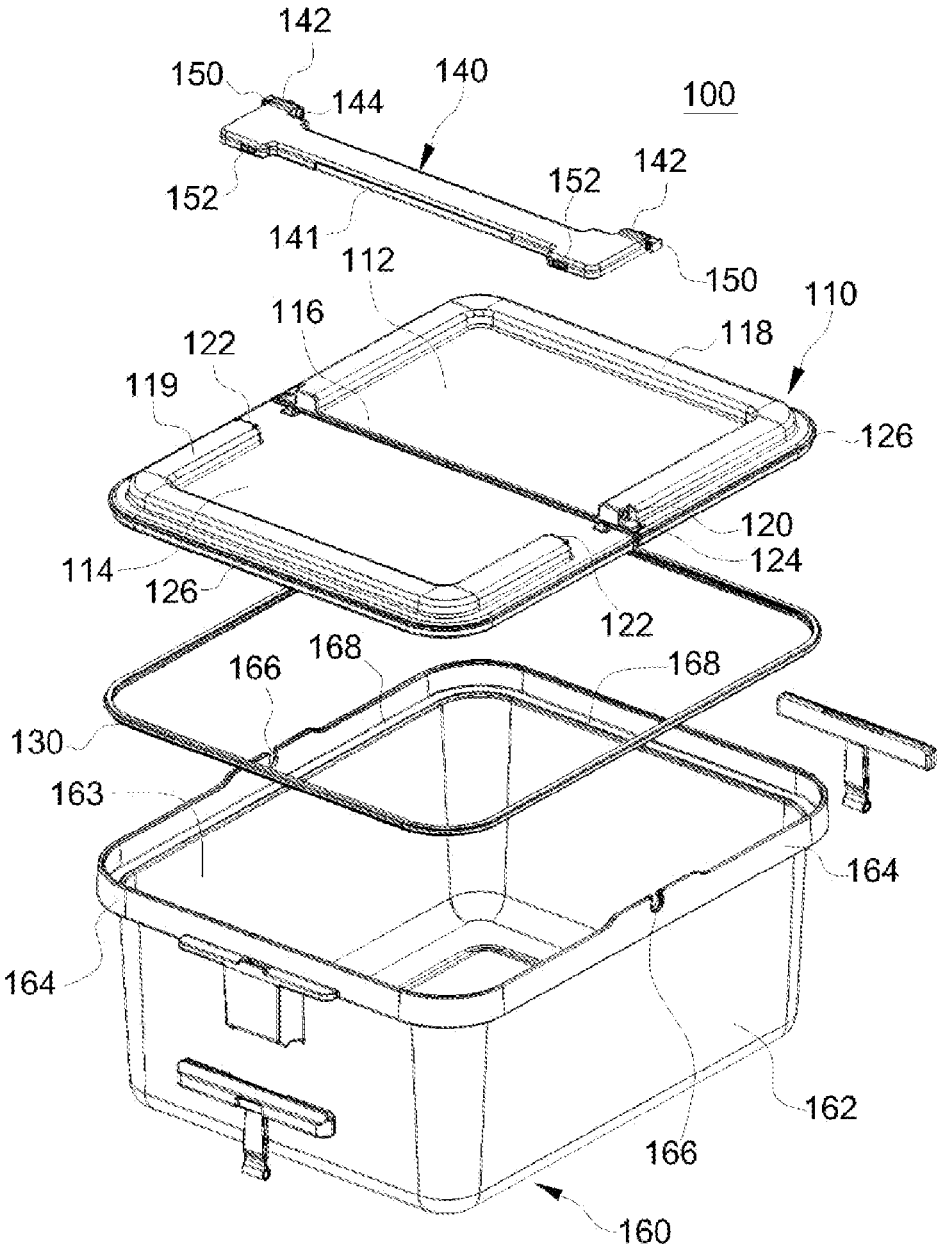
FIG. 2 is an exploded perspective view of the storage container illustrated in FIG. 1.
Figure 3:
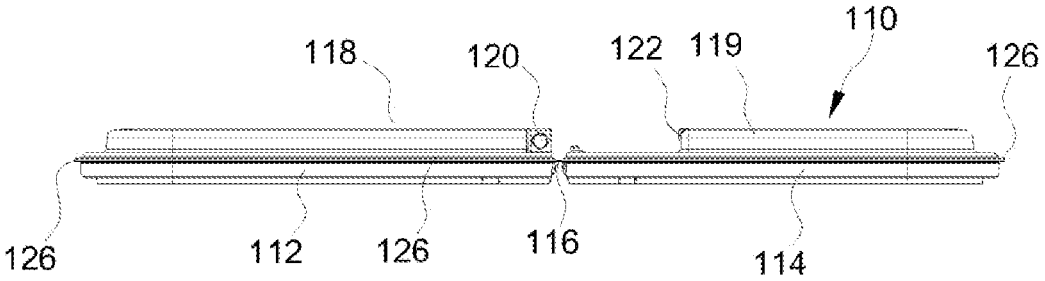
FIG. 3 illustrates a cover according to an embodiment of the present invention.
Figure 4:
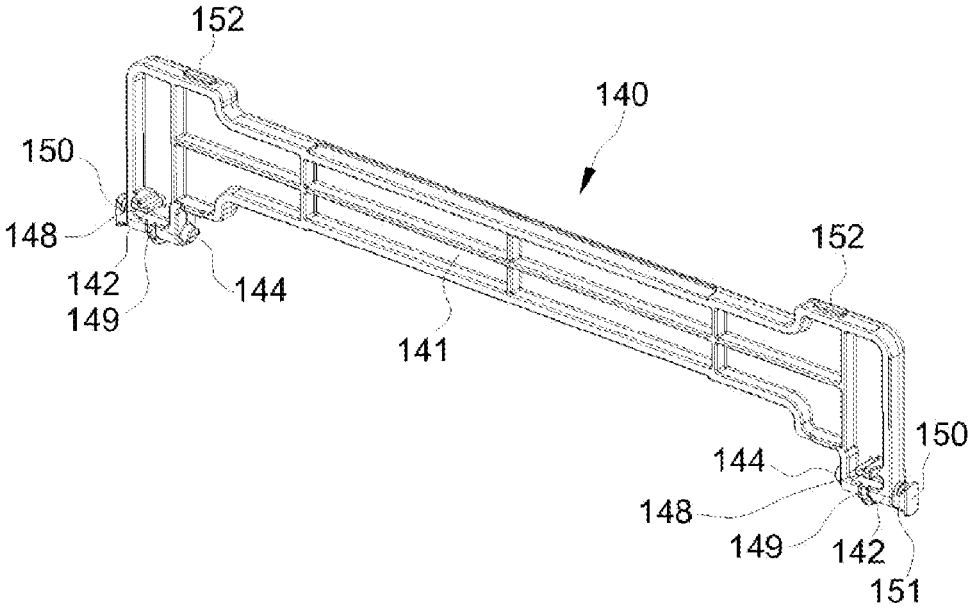
FIG. 4 illustrates a rotary pressing member according to an embodiment of the present invention.
Figure 5:
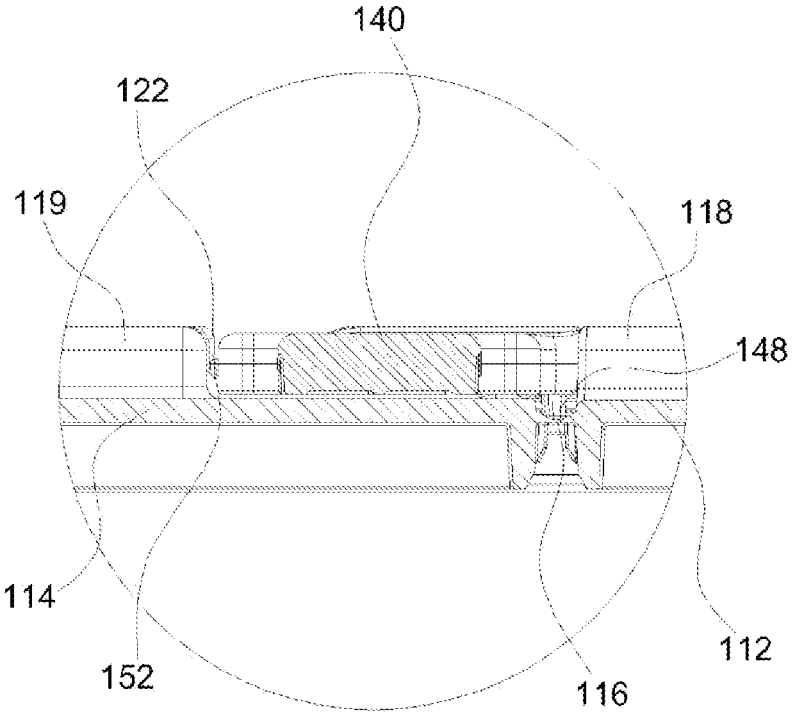
FIG. 5 is a cross-sectional view illustrating a locked state in which the rotary pressing member is coupled to the cover.
Figure 6:
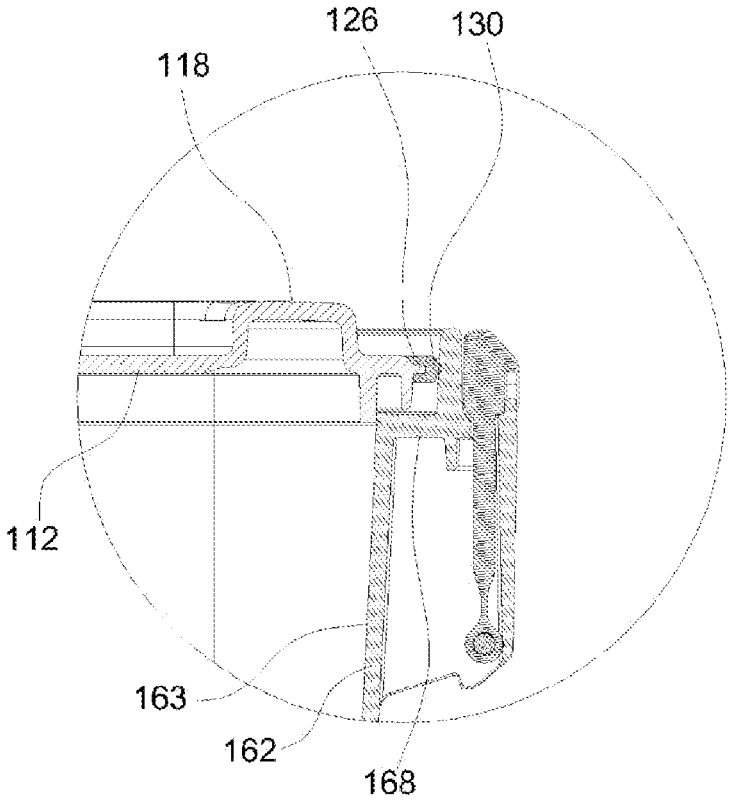
FIG. 6 is a cross-sectional view illustrating a state in which the cover is unfolded and the elastic element is placed in tight contact with an inner wall surface of the container body.
Figure 7:
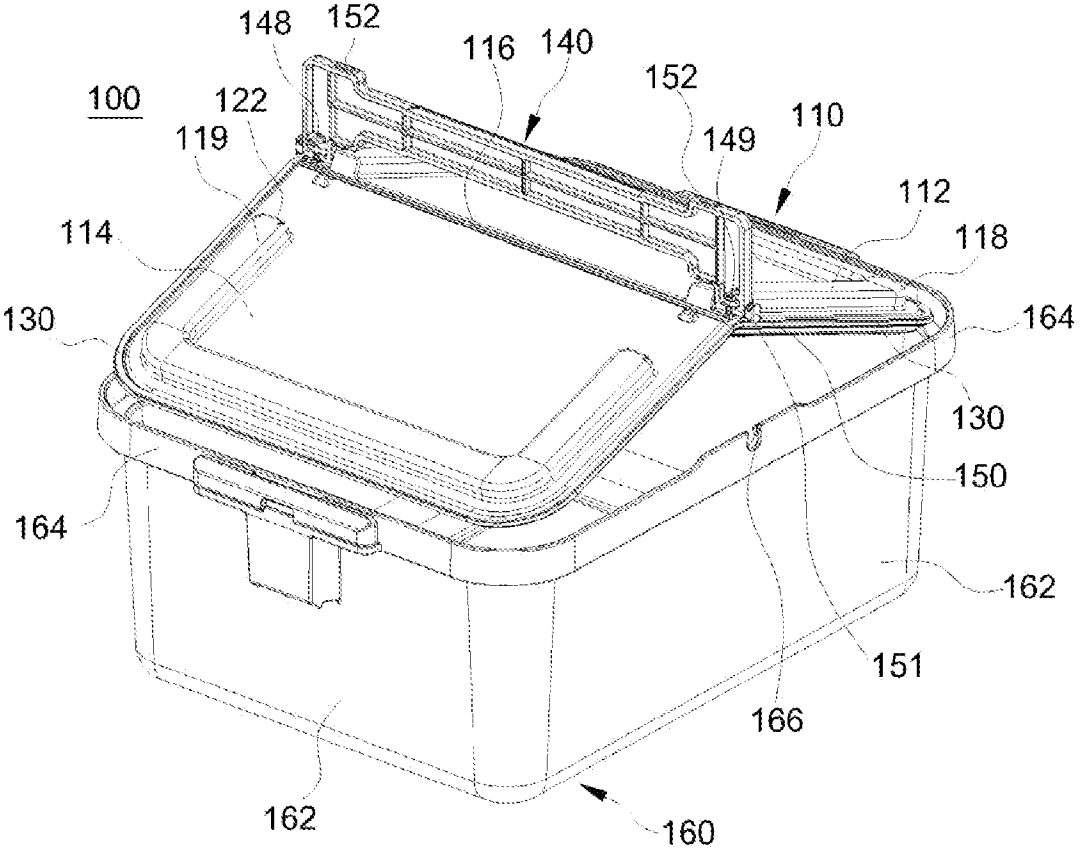
FIG. 7 illustrates a state in which the rotary pressing member is rotated to a vertical position and the cover is folded to be separated from the container body.

FIG. 1 is a perspective view illustrating a storage container 100 according to an embodiment of the present invention, and FIG. 2 is an exploded perspective view of the storage container 100 illustrated in FIG. 1. Incidentally, FIG. 1 illustrates a state in which the cover 110 of the storage container 100 seals the inner wall surfaces at an upper portion of the container body 160. FIG. 3 illustrates a cover 110 according to an embodiment of the present invention, and FIG. 4 illustrates a rotary pressing member 140 according to an embodiment of the present invention. FIG. 5 is a cross-sectional view illustrating a locked state in which the rotary pressing member 140 is coupled to the cover 110, and FIG. 6 is a cross-sectional view illustrating a state in which the cover 110 is unfolded and the elastic element 130 is placed in tight contact with the inner wall surface of the container body 160. FIG. 7 illustrates a state in which the rotary pressing member 140 is rotated to a vertical position and the cover 110 is folded to be separated from the container body.

A storage container 100 according to this embodiment may include a cover 110, a rotary pressing member 140, a container body 160, and handles 180. The cover 110 may be divided into a first cover 112 and a second cover 114 with respect to a folding line 116 and may have a structure that can be folded in the shape of an inverted "V" (^). Also, the rotary pressing member 140 may be rotatably coupled over the folding line 116 at an upper surface of the cover 110.

In a storage container 100 based on this embodiment, the cover 110 can be opened or sealed with respect to the container body 160 according to the direction of rotation of the rotary pressing member 140. For example, when the rotary pressing member 140 is positioned horizontally, the cover 110 can be kept in an unfolded state to maintain a sealed state (see FIG. 1). When the rotary pressing member 140 is positioned vertically, the cover 110 can be folded in the shape of an inverted "V" and can thus be separated from the container body 160 (see FIG. 7).

In a storage container 100 according to this embodiment, an elastic element 130 that provides a sealing effect can be coupled around the outer perimeter of the cover 110. The elastic element 130 can provide the sealing effect while contacting the inner wall surfaces 163 of the container body 160. Also, in cases where the inner wall surfaces 163 of the container body 160 are formed in a flat shape without having inner ledges 168 formed therein, the elastic element 130 can adjust the height of the cover 110 in correspondence to the height of the contained object while contacting the inner wall surfaces 163 to maintain a seal.

The container body 160 may have the shape of a rectangular parallelepiped and may be structured to have an open top. Thus, the container body 160 may have four sides 162.

Although the storage container 100 based on this embodiment is illustrated as having the shape of a rectangular parallelepiped, the present invention is not limited by the shape of the storage container 100. Obviously, a storage container based on another embodiment of the present invention can have any of a variety of shapes such as a cube, a circle, an ellipse, a polygon, etc.

Upper edges 164 may be formed at the upper end of the container body 160. The upper edges 164 may somewhat protrude outward from the upper ends of the sides 162. Also, inner ledges 168 may be formed in the inner wall surfaces at the upper end of the container body 160. The cover 110 may be inserted within the upper edges 164, at which instance the elastic element 130 coupled to the outer edge of the cover 110 may tightly contact the inner wall surfaces 163 and provide a sealing effect. The cover 110 can be supported on the inner ledges 168 to have a particular coupling height.

From among the upper edges 164, a pair facing each other may be provided with insertion notches 166 in their centers. An insertion notch 166 may be shaped as a notch having an open top. A body protrusion 150 of the rotary pressing member 140 can be rotatably inserted into the insertion notch 166. The width at the entrance of the insertion notch 166 can be formed to an extent that allows the insertion of the body protrusion 150 if the body protrusion 150 is positioned vertically (i.e., if the cut surfaces 151 are positioned vertically). Therefore, when the body protrusions 150 are rotated to or close to a horizontal position, the body protrusions 150 may not be detached from the insertion notches 166.

In a storage container 100 according to this embodiment, the cover 110 may have a shape corresponding to that of the container body 160 and may have a structure that can be folded in half at the folding line 116. The cover 110 can be divided into the first cover 112 and the second cover 114 with respect to the folding line 116. Also, the first cover 112 and the second cover 114 can be formed symmetrically with respect to the folding line 116. When the cover 110 is folded with respect to the folding line 116, the angle between the first cover 112 and second cover 114 can be formed smaller than 180 degrees. Also, when the cover 110 is unfolded as in FIG. 3, both the first cover 112 and the second cover 114 can be positioned horizontally.

The folding line 116 may connect the first cover 112 and second cover 114 with each other and enable relative rotation. Therefore, the folding line 116 can be formed relatively thinner than the first cover 112 and second cover 114 and can have a particular width to be capable of deformation. Thus, the folding line 116 may correspond to an elastic deformation segment having a small thickness.

Although FIG. 3 illustrates the folding line 116 as having a linear shape, a variety of other shapes such as curves, etc., are also possible. The width of the folding line 116 can determine the distance to which the first cover 112 and second cover 114 can expand or contract in the horizontal direction during the process of coupling the cover 110 to the container body 160.

Both ends of the folding line 116 may protrude outward so as to have the same height as the outer protrusions 126 that protrude outward from the outer edges of the cover 110. When the cover 110 is folded, both ends of the folding line 116 may be folded together. As a result, the elastic element 130 located at the end portions of the folding line 116 may also be folded.

The cover 110 can be formed by injection molding such that the first cover 112, second cover 114, and folding line 116 are formed as an integrated body. Of course, it is also possible to form the first cover 112 and second cover 114 separately before assembling these into an integrated body.

Although the folding line 116 is illustrated as being formed at the middle of the cover 110, a storage container according to other embodiments of the present invention can have the folding line formed in a position other than the middle of the cover.

On the upper surface of the cover 110, a first top protrusion 118 and a second top protrusion 119 having a "Π" shape may be formed facing each other with the folding line 116 in-between. The first top protrusion 118 and second top protrusion 119 may be formed protruding to a particular height from the cover 110. The second top protrusion 119 may be formed somewhat shorter than the first top protrusion 118. This is to provide a space in which the rotary pressing member 140 can tightly contact the upper surface of the cover 110.

The first top protrusion 118 may be provided with rotation indentations 120. The rotation indentations 120 may be indentations formed in the side surfaces at the ends of the first top protrusion 118. The cover protrusions 144 of the rotary pressing member 140 may be rotatably inserted in the rotation indentations 120. As a result, the rotary pressing member 140 can be made able to rotate in relation to the cover 110.

The second top protrusion 119 may be provided with cover detent protrusions 122. The cover detent protrusions 122 may correspond to protrusions formed on the upper portions at the ends of the second top protrusion 119. Rotation detent protrusions 152 formed on the rotary pressing member 140 may be caught on the cover detent protrusions 122. As a result, the rotary pressing member 140 can tightly contact the cover 110 as in FIG. 1, allowing the cover 110 to maintain an unfolded state. The upper surfaces and lower surfaces of the cover detent protrusions 122 can have sloped surfaces or can be tapered. This is to enable the rotation detent protrusions 152 of the rotary pressing member 140 to easily pass over the cover detent protrusions 122.

In one side at the ends of the first top protrusion 118, holding indentations 124 may be formed. A holding indentation 124 may correspond to an indentation of a particular length and depth formed vertically with respect to the folding line 116. Anti-detachment protrusions 149 of the rotary pressing member 140 can be inserted in the holding indentations 124. This can resolve the problem of the rotation of the rotary pressing member 140 being limited due to the anti-detachment protrusions 149 being caught on the upper surface of the cover 110 and can prevent the cover protrusions 144 of the rotary pressing member 140 from becoming detached from the rotation indentations 120.

The outer protrusions 126 may have a particular length and may protrude outwardly from the outer edges of the cover 110. The outer protrusions 126 can be formed along all or portions of the outer edges of the cover 110. Also, the elastic element 130 may be inserted onto the outer protrusions 126. As already mentioned above, the outer protrusions 126 can have the same height as the two end portions of the folding line 116. Thus, the elastic element 130 can protrude outwardly with the same length as other portions of the cover 110 even at the two ends of the folding line 116.

The outer protrusions 126 can be inserted into a detent groove or detent hole (not shown) formed in intaglio in the container body 160, whereby the first cover 112 and second cover 114 can be secured to the container body 160. At least one detent groove or detent hole can be formed in a particular position in the front, rear, or side of the container body 160.

A groove, not shown, can be formed in a lower surface of the cover 110, where the elastic element 130 can be inserted in the groove as well.

The elastic element 130 may be inserted along the entire outer edge of the cover 110 to provide a sealing effect. That is, when the cover 110 is coupled to the container body 160 as in FIG. 1, the elastic element 130 may tightly contact the inner wall surfaces 163 of the container body 160 and thus provide a sealing effect.

The elastic element 130 can be formed from rubber or a flexible plastic. Also, the elastic element 130 can be formed as an integrated body with the cover 110 by way of double injection molding or can be fabricated separately and subsequently assembled.

A storage container 100 according to another embodiment of the present invention can have the elastic element 130 inserted in a groove formed in the lower surface of the cover. In this way, the elastic element 130 coupled to an inner side of the cover 110 can be supported on the inner ledges 168 of the container body 160.

The rotary pressing member 140 may have a "Π" shape and may be rotatably coupled to the upper surface of the cover 110. Depending on its rotated position, the rotary pressing member 140 may serve as a handle by which to fold and open the cover 110 (see FIG. 7) or may unfold the cover 110 to seal the container body 160.

The rotary pressing member 140 may include a grip portion 141 having a "Π" shape and coupling portions 142 formed on both ends of the grip portion 141. The coupling portions 142 may be formed symmetrically on the two ends of the grip portion 141 and may have the same structure.

The coupling portions 142 may be provided with cover protrusions 144 that protrude inward. The cover protrusions 144 may be rotatably inserted into the rotation indentations 120 formed in the first top protrusion 118. This may allow the rotary pressing member 140 to be rotatably coupled to the cover 110.

The coupling portions 142 may be provided with outwardly protruding body protrusions 150. The body protrusions 150 may be inserted into the insertion notches 166 formed in the container body 160. A body protrusion 150 may be structured to have a cylindrical shape but with a parallel pair of cut surfaces 151 formed in the outer sides. Thus, the width of the body protrusions 150 can be altered according to the rotated position of the rotary pressing member 140. That is, when the rotary pressing member 140 is positioned vertically as in FIG. 7, the cut surfaces 151 may also be positioned vertically (such that the widths of the body protrusions 150 are decreased with respect to the vertical direction) and may thus be able to pass through the insertion notches 166. As a result, the body protrusions 150 can be retrieved from the insertion notches 166, and consequently the cover 110 can be separated from the container body 160 as in FIG. 7. When the rotary pressing member 140 is in or close to a horizontal position (such that the widths of the body protrusions 150 are increased with respect to the vertical direction), the cut surfaces 151 may also be placed in or close to a horizontal position so as to be unable to pass through the insertion notches 166. As a result, the body protrusions 150 may be unable to leave the insertion notches 166, and consequently the cover 110 may maintain an unfolded state and may be kept coupled to the container body 160.

Pressing protrusions 148 may correspond to protrusions formed symmetrically on the let and right sides on the coupling portions 142. When the rotary pressing member 140 is positioned horizontally as in FIG. 1 and is thus coupled to the upper surface of the cover 110, portions of the pressing protrusions 148 may press downward while in contact with the folding line 116. As a result, the first cover 112 and second cover 114 may be prevented from folding by the pressing protrusions 148 and may maintain an unfolded state.

The anti-detachment protrusions 149 may correspond to arc-shaped protrusions formed symmetrically on the left and right sides on the coupling portions 142. The anti-detachment protrusions 149 may be inserted into the holding indentations 124 to prevent the rotary pressing member 140 from becoming detached from the cover 110. Also, as the anti-detachment protrusions 149 press the bottom surfaces in the holding indentations 124, the cover 110 may be prevented from folding and may maintain an unfolded state.

The coupling portions 142 of the rotary pressing member 140 may be provided with rotation detent protrusions 152 formed on their upper ends. The rotation detent protrusions 152 may be caught on the cover detent protrusions 122 formed on the second top protrusion 119, so that the rotary pressing member 140 may be positioned horizontally on the upper surface of the cover 110 as in FIG. 1 and maintain the unfolded state of the cover 110. Also, as the cover 110 maintains an unfolded state, the elastic element 130 can press against the inner wall surfaces 163 of the container body 160 and maintain a sealing effect.

When the rotary pressing member 140 is rotated with a particular force, the rotation detent protrusions 152 may pass over the cover detent protrusions 122, and the detained state may be disengaged. Here, the pressing protrusions 148 of the rotary pressing member 140 may also be detached from or moved away from the folding line 116, allowing the first cover 112 and second cover 114 to be folded in an inverted "V" shape.

As shown in FIG. 7, the cover 110 can be inserted into the opening of the container body 160 while the first cover 112 and second cover 114 are in a folded state with respect to the folding line 116. Here, the rotary pressing member 140 can be in or close to a vertical position, whereby the body protrusions 150 can be inserted into the insertion notches 166, and the pressing protrusions 148 can be detached or separated from the folding line 116.

When the cover 110 is inserted into the opening of the container body 160 from the state illustrated in FIG. 7, the cover 110 may be supported on the inner ledges 168, and the body protrusions 150 may be rotatably inserted into the insertion notches 166. Then, when the rotary pressing member 140 is rotated from the vertical state into a horizontal state as illustrated in FIG. 1, the body protrusions 150 may be rotated without departing from the insertion notches 166, and the pressing protrusions 148 may downwardly press the folding line 116. As a result, the first cover 112 and second cover 114 may be completely unfolded as in FIG. 3 and positioned in a horizontal state.

During the course of the cover 110 being completely unfolded to a horizontal position, the elastic element 130 may tightly contact and/or overlap the inner wall surfaces 163 of the container body 160 to provide a sealing effect.

As the rotary pressing member 140 is rotated and placed in a horizontal position, the rotation detent protrusions 152 may pass over the cover detent protrusions 122 and be held by the cover detent protrusions 122. Thus, unless a force of a particular magnitude or greater is applied, the rotation detent protrusions 152 may be prevented from rotating due to the detent structure described above.

Thus, the cover 110 can maintain an unfolded state by way of the detent structure of the rotation detent protrusions 152 in relation to the cover detent protrusions 122 and the anti-detachment structure of the body protrusions 150 provided according to the rotated direction in relation to the insertion notches 166. As the cover 110 maintains an unfolded state, the elastic element 130 coupled along the outer edge of the cover 110 can press against the inner wall surfaces of the container body 160 and provide a sealing effect.

To separate the cover 110 from the container body 160, the rotary pressing member 140 in the state shown in FIG. 1 may be rotated with a particular force to the vertical position shown in FIG. 7 so as to open the cover 110. In the process, the rotation detent protrusions 152 may pass over the cover detent protrusions 122, and the detained state may be disengaged. Also, as the pressing protrusions 148 disengage from pressing against the folding line 116, the first cover 112 and second cover 114 can be folded about the folding line 116. Also, as the rotary pressing member 140 is positioned vertically as in FIG. 7, the body protrusions 150 can also be detached from the insertion notches 166.

When the rotary pressing member 140 is pulled up after having been rotated to a vertical position, the cover 110 can be separated from the container body 160 as the first cover 112 and second cover 114 are folded about the folding line 116 (see FIG. 7).

Although the storage container 100 according to this embodiment is illustrated as having inner ledges 168 on the inside of the container body 160, other embodiments of the present invention can have the container body 160 formed without inner ledges 168 such that the inner wall surfaces are flat. That is, the inner wall surfaces can be planes formed horizontally or with a downward slope without including inner ledges, in which case the cover 110 can be lowered while the elastic element 130 maintains contact with the inner wall surfaces 163. Thus, sealing can be provided with the height of the cover 110 adjusted in correspondence to the height of the object (not shown) contained within the container body 160. In this way, a storage container according to the embodiments described above can provide a sealing effect while allowing the user to store the contained object in an easy and convenient manner.

In the following, a storage container according to a second disclosed embodiment of the present invention is described, with reference to FIG. 8.

Figure 8:
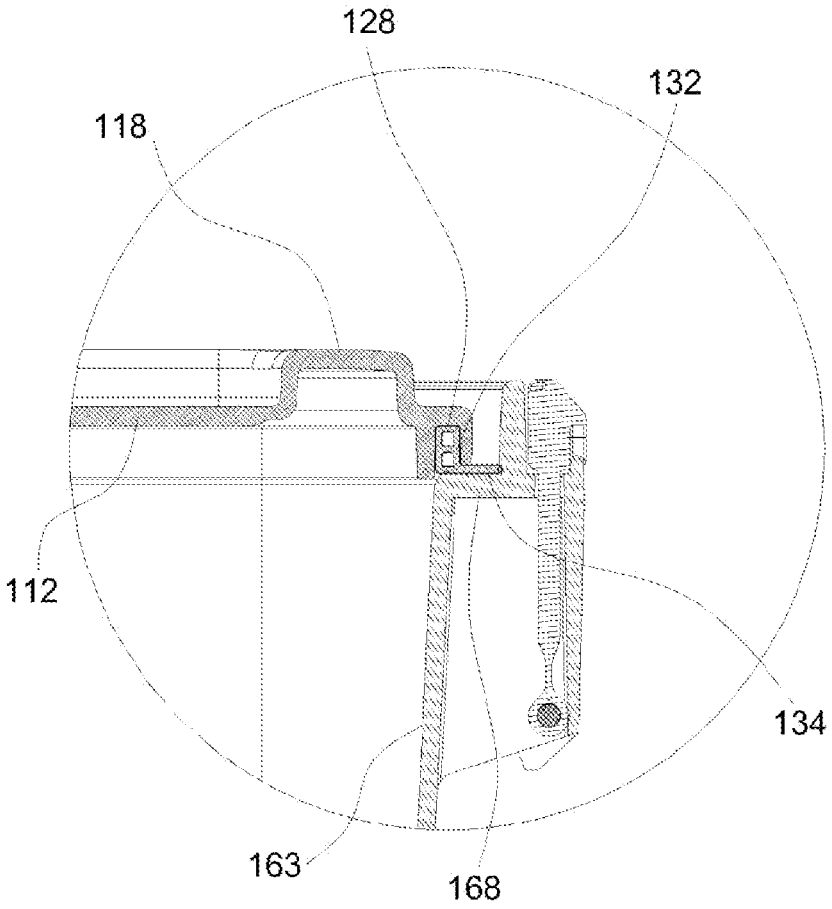
FIG. 8 is a cross-sectional view illustrating the elastic element placed in tight contact with an inner wall surface of the container body in a storage container according to a second disclosed embodiment of the present invention.

FIG. 8 is a cross-sectional view illustrating the elastic element 132 placed in tight contact with an inner wall surface 163 of the container body in a storage container according to a second disclosed embodiment of the present invention.

Referring to FIG. 8, the cover may be provided with an inner groove 128 instead of having outer protrusions 126. The inner groove 128 can be formed along the entire perimeter of the cover. The elastic element 132 can be inserted in the inner groove 128.

The elastic element 132 may have a portion thereof inserted in the inner groove 128 and may contact the inner ledge 168 to thereby provide a sealing effect. Also, an elastic element protrusion 134 formed on the side of the elastic element 132 may contact the inner wall surface 163 to provide a sealing effect. Of course, even in cases where there is no inner ledge 168 formed on the inner wall surface 163, the elastic element protrusion 134 can contact the inner wall surface 163 and thus provide a sealing effect.

In the following, a storage container 200 according to a third disclosed embodiment of the present invention is described, with reference to FIGS. 9 to 11.

Figure 9:
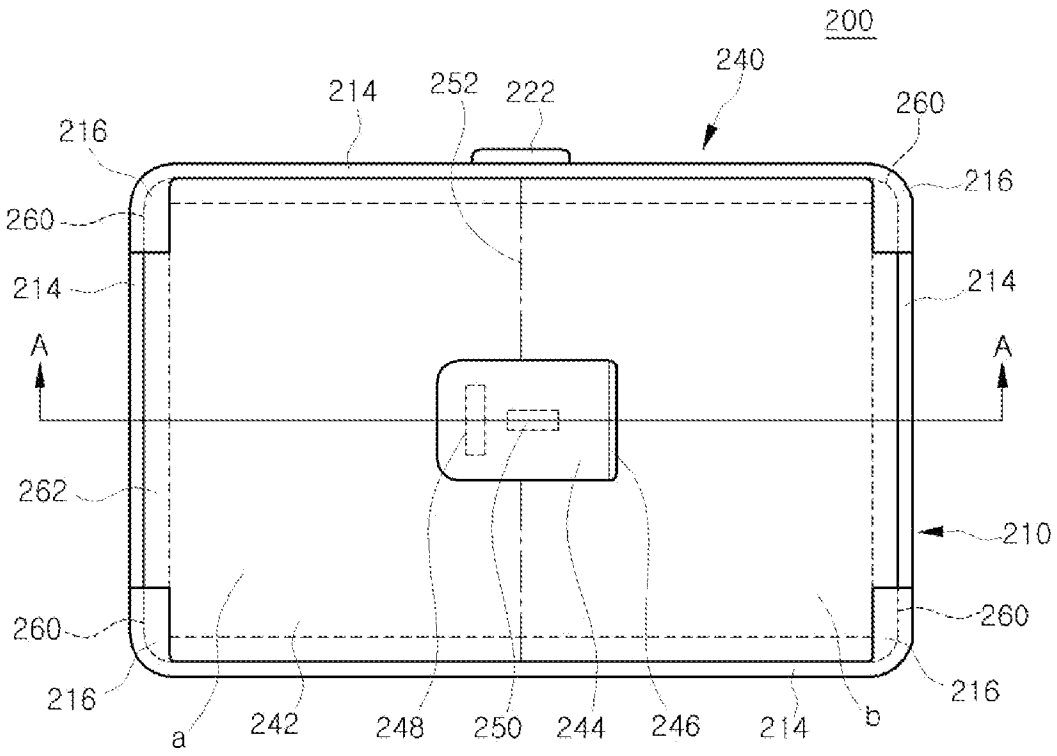
FIG. 9 is a plan view illustrating a storage container according to a third disclosed embodiment of the present invention.
Figure 10:
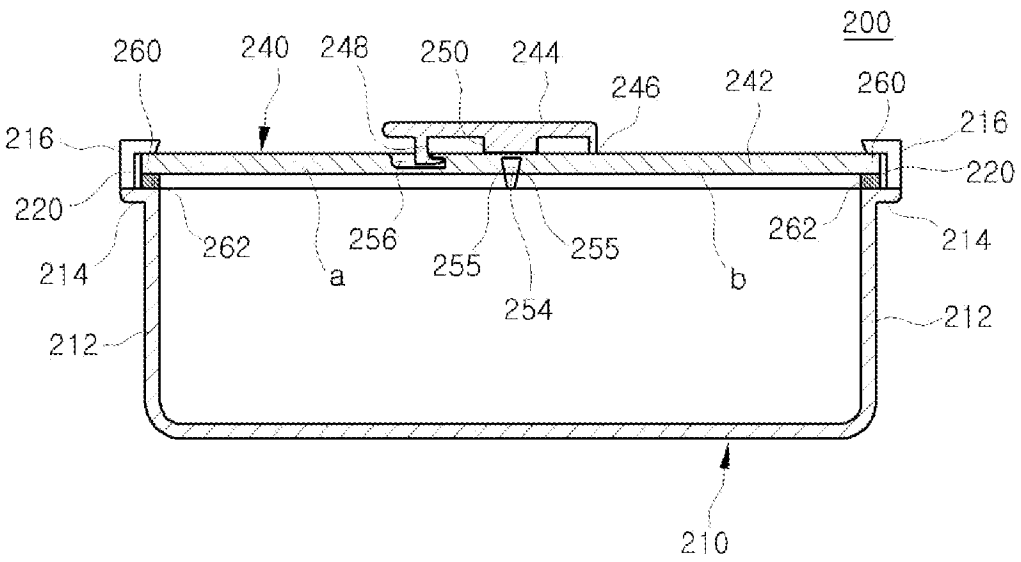
FIG. 10 is a cross-sectional view across line A-A of FIG. 9.

FIG. 9 is a plan view illustrating a storage container 200 according to a third disclosed embodiment of the present invention, and FIG. 10 is a cross-sectional view across line A-A of FIG. 9. FIG. 11 is a cross-sectional view illustrating how the cover 240 is coupled to the container body 210 in a storage container 200 according to a third disclosed embodiment of the present invention.

Figure 11:
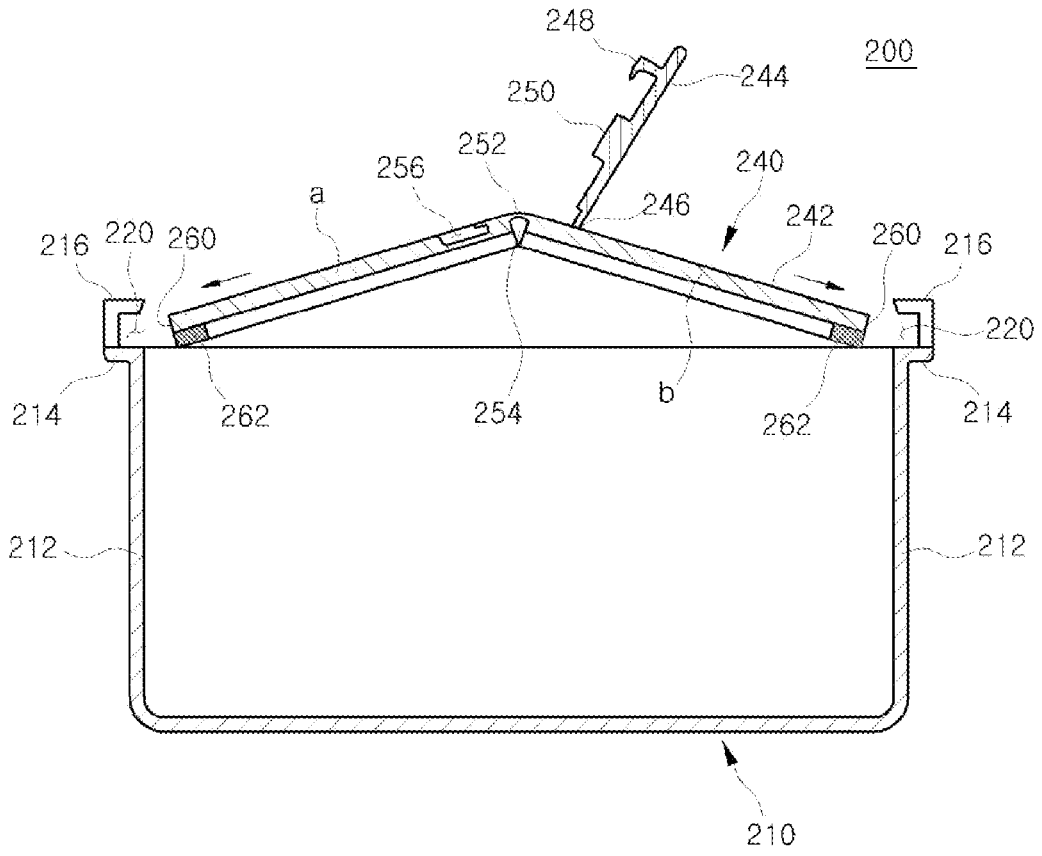
FIG. 11 is a cross-sectional view illustrating how the cover is coupled to the container body in a storage container according to a third disclosed embodiment of the present invention.

Referring to FIGS. 9 to 11, a storage container 200 according to a third disclosed embodiment of the present invention may include a container body 210 and a cover 240. The cover 240 may be coupled to the upper portion of the container body 210 to seal the opening. In a storage container 200 according to this embodiment, the cover 240 may be structured to be capable of folding in half with respect to the folding line 252. As the cover 240 folds with respect to the folding line 252, the end portions may be separated from the detent grooves 220 of the container body 210. As the cover 240 unfolds, the end portions can be caught on the detent grooves 220, so that a sealing effect can be provided.

The cover 240 may be provided with a first cover (a) and a second cover (b) divided by the folding line 252. When the cover 240 is folded by the folding line 252, the first cover (a) may undergo a rotation relative to the second cover (b). Also, when the cover 240 is unfolded by the folding line 252, the first cover (a) and the second cover (b) can form a single plane.

On the upper surface of the cover 240, a pressing member 244 may be formed as an integrated body with the cover 240. The pressing member 244 may enable the cover 240 to maintain an unfolded state. The cover 240 of a storage container 200 based on this embodiment is characterized in that the pressing member 244 may be formed as an integrated body with the cover 240 through a single process instead of being fabricated separately and coupled with the cover 240 afterwards.

Although the cover 240 according to this embodiment is illustrated as being separated into the two parts of a first cover (a) and a second cover (b) by a single folding line 252, other embodiments of the present invention can have the cover divided into three or more parts.

In this way, with a storage container 200 according to this embodiment, the cover 240 can be coupled and separated from the container body 210 by a single motion, thus allowing convenient use.

The container body 210 may include an interior space of a particular size with an open top. In a storage container 200 according to this embodiment, the container body 210 may have a horizontal cross section shaped as a quadrilateral, so that there may be four sides 212 formed. Each side 212 may be provided with an upper edge 214 at its upper end.

The upper edges 214 may be structured to extend outward in a particular length from the sides 212. An upper edge 214 can be formed along the entirety of the side 212 or can be formed selectively only at portions where the detent grooves 220 are formed. The upper edges 214 may be provided with detent portions 216.

The detent portions 216 may be protrusions having a "7" shape and can be formed on the four edges of the container body 210. The detent portions 216 can be formed such that a pair is formed symmetrically to each other on the left and right with respect to the folding line 252. Of course, the present invention is not limited by the number and arrangement of the detent portions 216.

The detent grooves 220 may be formed by the detent portions 216. The edge portions of the cover 240 may be inserted into and caught on the detent grooves 220. The detent grooves 220 may be provided with entrances through which the edge portions of the cover 240 may be inserted. The entrances may be structured to be open in directions that allow an easy insertion of the end portions of cover 240 being unfolded.

On one side of the container body 210, a press protrusion 222 may be provided. When separating the cover 240 from the container body 210, the user may press the press protrusion 222 with a hand to easily separate the cover 240 from the container body 210.

The cover 240 may have a shape corresponding to that of the container body 210 and may serve to close the opening at the upper portion of the container body 210 and provide a sealing effect.

The cover 240 may be structured to be capable of folding in half with respect to an imaginary line at the folding line 252. As illustrated in FIG. 11, it is possible to separate the cover 240 from the container body 210 by folding the cover 240 with respect to the folding line 252. Also, it is possible to couple the cover 240 with the container body 210 by unfolding the cover 240 with respect to the folding line 252 such that the end portions are caught on the detent grooves 220 of the detent portions 216.

A folding groove 254 having a particular depth may be formed in the lower surface of the cover 240. The folding groove 254 may correspond to a groove formed across the cover 240 overall in a lateral or longitudinal direction. Such folding groove 254 can enable the cover 240 to be folded or unfolded with respect to the folding line 252.

The folding groove 254 may be formed only in the lower surface of the cover 240 (the opposite surface of the upper surface 242 on which the pressing member 244 is formed). Thus, the cover 240 may be structured to be capable of folding in the direction of the folding groove 254.

Of course, the cover in a storage container according to another embodiment of the present invention can be structured to be capable of folding in both directions.

The extent to which the cover 240 can be folded can be determined by the folding groove 254. That is, when the cover 240 is folded to the maximum extent, the fold surfaces 255 on the left and right may contact each other and thus may not permit the cover 240 to fold any further. In this way, the folding groove 254 can serve as a stopper that limits the folding of the cover 240.

A pressing member 244 may be provided on the upper surface 242 of the cover 240. The pressing member 244 may be provided to maintain the unfolded state of the cover 240 and can be formed as an integrated body with the cover 240 by way of plastic injection molding. The pressing member 244 may be provided with a rotary hinge 246, a locking protrusion 248, and a pressing protrusion 250.

The rotary hinge 246 may correspond to the center of rotation of the pressing member 244 and can be a portion formed with a small thickness on the pressing member 244. In a storage container 200 according to this embodiment, the rotary hinge 246 may be positioned parallel to and with a particular distance from the folding line 252. Thus, when the pressing member 244 is coupled to the upper surface 242 of the cover 240, the pressing member 244 may cover the folding line 252 as illustrated in FIG. 9.

On the inner side of the pressing member 244, there may be provided a locking protrusion 248 and a pressing protrusion 250.

The locking protrusion 248 may have a "7" shape and may correspond to a portion that is inserted in and caught on a locking cavity 256 that is formed on the opposite side of the rotary hinge 246 with respect to the folding line 252. Thus, the pressing member 244 may be coupled to the upper surface 242 of the cover 240 while positioned over the folding line 252, preventing the cover 240 from being folded. As the pressing member 244 does not allow the cover 240 to fold, the cover 240 can be kept coupled to the container body 210 as in FIG. 9 and FIG. 10.

As storage container according to another embodiment of the present invention can have the locking cavity formed on the pressing member and the locking protrusion formed on the upper surface of the cover. Also, a storage container according to another embodiment of the present invention can have the pressing member coupled to the cover by any of a variety of methods, some examples of which may utilize Velcro, magnets, vacuum suction pieces (suction cups), etc.

The pressing protrusion 250 may be formed protruding from the inner side of the pressing member 244. When the pressing member 244 is coupled to the upper surface 242 of the cover 240, the pressing protrusion 250 may press against the upper surface 242 while positioned over the folding line 252. Thus, the cover 240 can maintain an unfolded state.

The pressing member 244 can be formed from the same material (e.g., plastic resin) as that of the cover 240. As the pressing member 244 is coupled to the cover 240, the cover 240 can maintain an unfolded state, as illustrated in FIG. 10, and can thereby be kept coupled with the container body 210.

The pressing member 244 may be coupled to the locking cavity 256 provided in the upper surface 242 of the cover 240. The locking cavity 256 may be provided in a surface symmetrically opposite the surface where the rotary hinge 246 is positioned with respect to the folding line 252.

A packing 262 can be provided on one side of the cover 240. The packing 262 can be formed over the entire edge of the cover 240. When the cover 240 is coupled to the container body 210, the packing 262 may be compressed to provide a sealing effect.

In the following, the method of use of a storage container 200 according to the third disclosed embodiment of the present invention is described.

First, for coupling with the container body 210, the cover 240 may be folded and positioned over the container body 210, as illustrated in FIG. 11. Here, the pressing member 244 of the cover 240 may not yet be coupled to the upper surface 242. From the state shown in FIG. 11, when the pressing member 244 is pressed downward, the first cover (a) and second cover (b) of the cover 240 may be unfolded, and the respective edges 260 may be inserted into the detent grooves 220 corresponding to the detent portions 216. Afterwards, in order that the cover 240 may not be folded again, the pressing member 244 may be rotated to insert the locking protrusion 248 into the locking cavity 256, yielding the state shown in FIG. 10 where the coupling of the cover 240 is completed. Thus, the pressing member 244 coupled to the upper surface 242 may be positioned over the folding line 252 and prevent the cover 240 from being folded.

Referring to FIG. 9 and FIG. 10, when the cover 240 is completely coupled to the container body 210, the cover 240 may completely cover the opening of the container body 210. The four edges 260 of the cover 240 may be inserted in the detent grooves 220 formed by the detent portions 216. As a result, the cover 240 may not easily become detached or separated from the container body 210.

To separate the cover 240 coupled to the container body 210, from the state shown in FIG. 9 and FIG. 10, the pressing member 244 may first be separated from the upper surface 242. When the pressing member 244 is lifted up from the state shown in FIG. 9 and FIG. 10, the locking protrusion 248 may be separated from the locking cavity 256 and may rotate in one direction (in FIG. 10, the clockwise direction). Due to the force separating the pressing member 244 from the upper surface 242, i.e., the force lifting the pressing member 244 upward, the pressing member 244 may be separated from the upper surface 242, and at the same time, the cover 240 may be folded with respect to the folding line 252. As the cover 240 is folded, the respective edges 260 of the first cover (a) and second cover (b) may be detached from the detent grooves 220 of the detent portions 216 and result in the configuration shown in FIG. 11.

Thus, in a storage container 200 according to this embodiment, a force for coupling the pressing member 244 onto the upper surface 242 of the cover 240, i.e., a pushing force, can unfold the folded cover 240 for coupling to the detent grooves 220 provided in the container body 210 and also couple the pressing member 244. As such, a storage container 200 according to this embodiment provides the advantage of convenient use by allowing the user to couple the cover 240 to the container body 210 and couple the pressing member 244 to the upper surface 242 with a single motion of pushing down on the pressing member 244.

Also, in a storage container 200 according to this embodiment, a force for separating the pressing member 244 from the upper surface 242 of the cover 240, i.e., an upwardly pulling force, can separate the pressing member 244 from the upper surface 242 while at the same time folding the cover 240 for disengaging from the detained state at the detent grooves 220. As such, a storage container 200 according to this embodiment also provides the advantage of convenient use by allowing the user to separate the pressing member 244 from the upper surface 242 and fold the cover 240 for separation from the container body 210 with a single motion of pulling up the pressing member 244.

Although the storage container 200 based on this embodiment is illustrated with the detent portions 216 for forming the detent grooves 220 illustrated as being formed symmetrically on the four edges of the container body 210, the present invention is not limited by the number and arrangement of the detent portions 216. A storage container according to another embodiment of the present invention can have a pair or two or more pairs of detent portions arranged opposite each other in left-right symmetry. It is also possible to have the detent portions formed not on the edge portions but on middle portions on the sides.

While the descriptions above refer to certain embodiments of the present invention, the person having ordinary skill in the relevant field of art would understand that various modifications and alterations of the present invention can be made without departing from the spirt and scope of the present invention as set forth in the scope of claims below.

What is claimed is:

1. A storage container comprising:

a container body; and a cover comprising a folding line enabling folding and unfolding and a first cover and a second cover provided on a left and a right side of the folding line, wherein the storage container further comprises a rotary pressing member rotatably provided on or near the folding line, the cover is configured to be insertable onto the container body while in a folded state with respect to the folding line, the cover is unfolded with respect to the folding line by a rotation of the rotary pressing member in one direction, a coupling of the rotary pressing member onto the cover and/or the container body causes the cover to maintain an unfolded state, and the cover is folded with respect to the folding line by a rotation of the rotary pressing member in the other direction so as to be separable from the container body, wherein the rotary pressing member comprises a grip portion and a pair of coupling portions formed on both ends of the grip portion, respectively, each coupling portion comprising a body protrusion rotatably inserted into an insertion notch formed on the container body, wherein a width of the body protrusion is less than an entrance width of the insertion notch when the body protrusion is in a vertical position such that the body protrusion is capable of being disengaged from the insertion notch, wherein the width of the body protrusion is greater than the entrance width of the insertion notch when the body protrusion is in a horizontal position such that the body protrusion is locked in the insertion notch.

2. The storage container of claim 1, further comprising an elastic element coupled to an outer edge and/or an inner side of the cover, wherein a coupling of the rotary pressing member onto the cover and/or the container body causes the elastic element to tightly contact an inner wall surface and/or an inner ledge of the container body.

3. The storage container of claim 2, wherein the elastic element is formed from a rubber or flexible plastic material and is formed as an integrated body with or assembled onto the cover.

4. The storage container of claim 1, wherein the cover comprises an outer protrusion configured to receive an elastic element coupled thereto, and an end portion of the folding line serving as an elastic deformation segment protrudes with a same length as the outer protrusion.

5. The storage container of claim 4, wherein the outer protrusion is inserted into a detent groove or detent hole formed in intaglio in the container body so as to secure the first cover and/or the second cover onto the container body.

6. The storage container of claim 5, wherein at least one detent groove or detent hole is formed in a particular position in a front, rear, or side of the container body.

7. The storage container of claim 1, wherein the rotary pressing member is formed as an integrated body with the cover or is formed as a separate body and assembled onto the cover.

8. The storage container of claim 1, wherein the rotary pressing member comprises a pressing protrusion, and a rotation of the cover in one direction causes the pressing protrusion to press the folding line such that the first cover and second cover maintain an unfolded state.

9. The storage container of claim 8, wherein one of a rotation detent protrusion and an anti-detachment protrusion provided on the rotary pressing member is coupled to or pressed against the other of a cover detent protrusion and a holding indentation provided on the cover such that the rotary pressing member maintains a coupled state with the cover.

10. The storage container of claim 2, wherein the elastic element creates an overlap when placed in tight contact with an inner wall surface of the container body.

11. The storage container of claim 1, wherein the container body comprises an inner ledge, and the cover is supported on the inner ledge.

12. The storage container of claim 2, wherein the container body comprises an inner wall surface having a flat form, and the cover is capable of upward and downward movement while the elastic element is in tight contact with the inner wall surface.

13. The storage container of claim 1, wherein a cross section of the container body is shaped as any one of a circle, rectangle, square, and polygon.

14. The storage container of claim 1, wherein one of a rotation detent protrusion and an anti-detachment protrusion provided on the rotary pressing member is coupled to or pressed against the other of a cover detent protrusion and a holding indentation provided on the cover such that the rotary pressing member maintains a coupled state with the cover.

* * * * *